US005713180A

United States Patent [19]

Lewis

[11] Patent Number: 5,713,180

[45] Date of Patent: Feb. 3, 1998

[54] SYSTEM FOR TRANSPORTING CONTAINERS FOR USE WITH AN APPARATUS TO PROCESS CONTAINERS SUCH AS A TABLET FILLING MONOBLOCK

[75] Inventor: Graham L. Lewis, Beaconsfield, Canada

[73] Assignee: H. G. Kalish, Inc., Canada

[21] Appl. No.: 366,437

[22] Filed: Dec. 30, 1994

Related U.S. Application Data

[63] Continuation of Ser. No. 214,021, Mar. 15, 1994, abandoned, which is a continuation of Ser. No. 64,797, May 21, 1993, abandoned, which is a continuation of Ser. No. 764,323, Sep. 24, 1991, abandoned.

[51] Int. Cl.[6] ..... B65B 43/50

[52] U.S. Cl. ..... 53/253; 53/249; 53/282; 53/283; 53/501

[58] Field of Search ..... 53/237, 240, 249, 53/253, 272, 276, 277, 278, 279, 280, 281, 282, 283, 287, 308, 313, 317, 501; 141/144, 145, 168, 170, 178; 198/346.2, 480.1, 852

[56] References Cited

U.S. PATENT DOCUMENTS

| | | | |
|---|---|---|---|
| 2,029,303 | 2/1936 | Ball . | |
| 2,446,377 | 8/1948 | Marshall . | |
| 2,510,568 | 6/1950 | Fouse | 53/308 |
| 3,061,990 | 11/1962 | Lakso | 53/237 |
| 3,068,623 | 12/1962 | Lakso | 53/237 X |
| 3,073,090 | 1/1963 | Roberts et al. | 53/317 |
| 3,259,152 | 7/1966 | Schimkat . | |
| 3,730,235 | 5/1973 | Lewis . | |
| 3,788,447 | 1/1974 | Stephanoff | 198/852 X |
| 3,878,874 | 4/1975 | Heckman . | |
| 3,908,719 | 9/1975 | Berg et al. . | |
| 3,910,404 | 10/1975 | Henrekson | 198/852 X |
| 3,994,117 | 11/1976 | Kinney | 53/282 X |
| 4,073,372 | 2/1978 | List | 53/282 X |
| 4,252,230 | 2/1981 | Eriksson . | |
| 4,378,665 | 4/1983 | Crankshaw et al. . | |
| 4,567,919 | 2/1986 | Fogg et al. | 141/145 X |
| 4,674,259 | 6/1987 | Hills | 53/501 X |
| 4,878,333 | 11/1989 | Sommerfield | 53/282 X |

FOREIGN PATENT DOCUMENTS 795081 12/1935 France .

*Primary Examiner*—Daniel Moon
*Attorney, Agent, or Firm*—Larson and Taylor

[57] ABSTRACT

A system for transporting containers in serial order through container-processing stations, such as filling and capping stations. The transporting system comprises a revolving turret defining a plurality of container receiving pockets in a spaced apart relationship for serially advancing containers from one processing station to another along a generally arcuate path. Each pocket is configured to accept and release a container along predetermined ingress and egress directions respectively. An endless conveyor supplies unprocessed containers to the revolving turret and also removes the processed containers therefrom. The conveyor defines infeed and outfeed runs advancing containers along the ingress and egress directions respectively of pockets registering with the infeed and outfeed runs, whereby movement of the conveyor causes a forwardmost, unprocessed container on the infeed run to enter a pocket registering with the infeed run and also causes the outfeed run to extract a processed container from a pocket registering therewith. The infeed and the outfeed runs are substantially in a non-coaxial condition to extend the effective sector of the revolving turret substantially beyond 180°. The conveyor also includes an intermediate segment beneath the revolving turret, interconnecting the infeed and the outfeed runs for maintaining the continuity of the conveyor. A drive system rotates the turret and advances the conveyor. The invention also extends to a container processing apparatus, such as a tablet filling monoblock, utilizing the novel container transporting system.

7 Claims, 1 Drawing Sheet

SYSTEM FOR TRANSPORTING CONTAINERS FOR USE WITH AN APPARATUS TO PROCESS CONTAINERS SUCH AS A TABLET FILLING MONOBLOCK

This application is a continuation of application Ser. No. 08/214,021 filed Mar. 15, 1994, now abandoned; which is a continuation of application Ser. No. 08/064,797 filed May 21, 1993, now abandoned; which is a continuation of application Ser. No. 07/764,323 filed Sep. 24, 1991, now abandoned.

FIELD OF THE INVENTION

The invention relates to the field of automatic container processing equipment. More particularly, the invention pertains to a novel, compact system for transporting containers in serial order through container-processing stations, such as filling stations, capping stations, labelling stations and the like. The invention also extends to a container processing machine utilizing the novel container transport system, such as a tablet filling mono block.

BACKGROUND OF THE INVENTION

Modern bottling plants utilize automatic machinery to fill and cap containers. A typical container processing machine comprises a plurality of processing stations performing specific operations in consecutive order on containers transported in serial order through the processing stations bank. To achieve a high degree of precision in properly positioning the containers at each processing station, it is common practice to employ a revolving turret, so-called "star-wheel", advancing the containers along an arcuate path while maintaining the containers captive in circumferential pockets to prevent any deviation from the path of travel. The various container processing stations are positioned along the arcuate path.

Normally, an endless conveyor is coupled with the revolving turret to supply unprocessed containers thereto and remove the processed containers from the revolving turret. The conveyor is directed to pass beneath the revolving turret intercepting its axis of revolution and defining co-axial infeed and outfeed runs, interconnected by a straight segment passing under the revolving turret.

This arrangement has the advantage of being mechanically simple, however, it is not particularly efficient because the effective sector of the revolving turret, i.e. the sector from the infeed run to the outfeed run of the conveyor along which the containers travel, is short as it does not exceed 180°, thus limiting the number of processing stations which can be installed besides the revolving turret.

To overcome this difficulty, the prior art suggests to use timing screws, instead of a conveyor, to feed unprocessed bottles and remove processed bottles from the revolving turret. The infeed and the outfeed timing screws can be positioned close to one another, permitting to extend the effective sector of the revolving turret considerably beyond 180°. As a result, a more compact container processing machine may be built because a larger number of processing stations may be coupled with the revolving turret. However, a container transport system which utilizes timing screws is very complex as elaborate drives are required for each timing screw. As a result, the system is costly to build and requires extensive maintenance to operate satisfactorily.

OBJECTS AND STATEMENT OF THE INVENTION

An object of the invention is a system for transporting containers which is relatively simple and compact while providing an effective sector on the revolving turret extending considerably beyond 180° to accommodate a comparatively large number of container-processing stations.

Another object of the invention is a container processing machine such as a tablet filling monoblock utilizing the container transport system of the invention.

As embodied and described herein, the invention provides an apparatus for processing containers, comprising:

a system for transporting containers in serial order, said system including:

a) a revolving turret defining a plurality of container-receiving pockets in a spaced apart relationship for serially advancing containers along a generally arcuate path;

b) an endless conveyor for supplying unprocessed containers to said revolving turret and for removing processed containers therefrom, said conveyor defining an infeed run extending generally radially relative to said revolving turret for feeding containers to said revolving turret and an outfeed run extending generally radially relative to said revolving turret to convey containers away from said revolving turret, said runs being in a substantially non-coaxial condition thereby said arcuate path has an angle substantially in excess of 180°, whereby movement of said conveyor causes a forwardmost, unprocessed container on said infeed run to enter a pocket registering with said infeed run and also causes said outfeed run to extract a processed container from a pocket registering therewith, said conveyor further including an intermediate segment, beneath a portion of said revolving turret other than a portion including said container receiving pockets, interconnecting said infeed and outfeed runs for maintaining the continuity of said conveyor therebetween; and container-processing stations along said arcuate path, said stations processing containers advanced by said revolving turret in a consecutive order.

This container transport system is extremely advantageous because it retains the simplicity of conventional revolving turret/straight conveyor arrangement while permitting to increase the effective sector of the revolving turret considerably beyond 180°.

In a preferred embodiment, the conveyor is made of slats which are capable of relative co-planar movement (for the purpose of the specification "co-planar movement" should be construed to mean a movement of one slat relative to the other while both slats remain in a co-planar relationship) permitting to alter the angular relationship between adjacent slats, whereby the conveyor can follow a curved path. As a result, the infeed and the outfeed runs can be brought in adjacency, the segment of the conveyor between the infeed and the outfeed runs forming a sharp loop.

Preferably, the pockets on the revolving turret present a radial axis of symmetry, thereby containers are entered and removed from the pockets along radial directions. As a result, the infeed and the outfeed runs of the conveyor are oriented radially with respect to the revolving turret, to achieve smooth container ingress/egress action.

As embodied and broadly described herein, the invention provides an apparatus for processing containers, comprising:

a system for transporting containers in serial order, said system including:

a) a revolving turret defining a plurality of container-receiving pockets in a spaced apart relationship for serially advancing containers along a generally arcuate path;

b) an endless conveyor for supplying unprocessed containers to said revolving turret and for removing processed containers therefrom, said conveyor defining an infeed run for feeding containers to said revolving turret and an outfeed run to convey containers away from said revolving turret said runs being in a substantially non-coaxial condition thereby said arcuate path has an angle substantially in excess of 180°, whereby movement of said conveyor causes a forwardmost, unprocessed container on said infeed run to enter a pocket registering with said infeed run and also causes said outfeed run to extract a processed container from a pocket registering therewith, said conveyor further including an intermediate segment, beneath a portion of said revolving turret other than a portion including said container receiving pockets interconnecting said infeed and outfeed runs for maintaining the continuity of said conveyor therebetween, said revolving turret constituting means for disengaging a given container from said infeed run in order to advance the container along said arcuate path, said revolving turret also constituting means for engaging the container on said outfeed run when the container reaches an end of said arcuate path; and container-processing stations along said arcuate path, said stations processing containers advanced by said revolving turret in a consecutive order.

The container transport system according to the invention has been found particularly advantageous for use with a machine for filling containers with tablets, so called "tablet filling monoblock". Such machine comprises a tablet counting and filling station to dispense a predetermined number of tablets in each container, a station to apply wads of cotton or similar material in the containers and a capping station downstream the station to apply the wads to seal the containers.

BRIEF DESCRIPTION OF THE DRAWING

The annexed FIGURE is a perspective, fragmentary view of a tablet filling monoblock constructed in accordance with the present invention.

DESCRIPTION OF A PREFERRED EMBODIMENT

Figure 1:
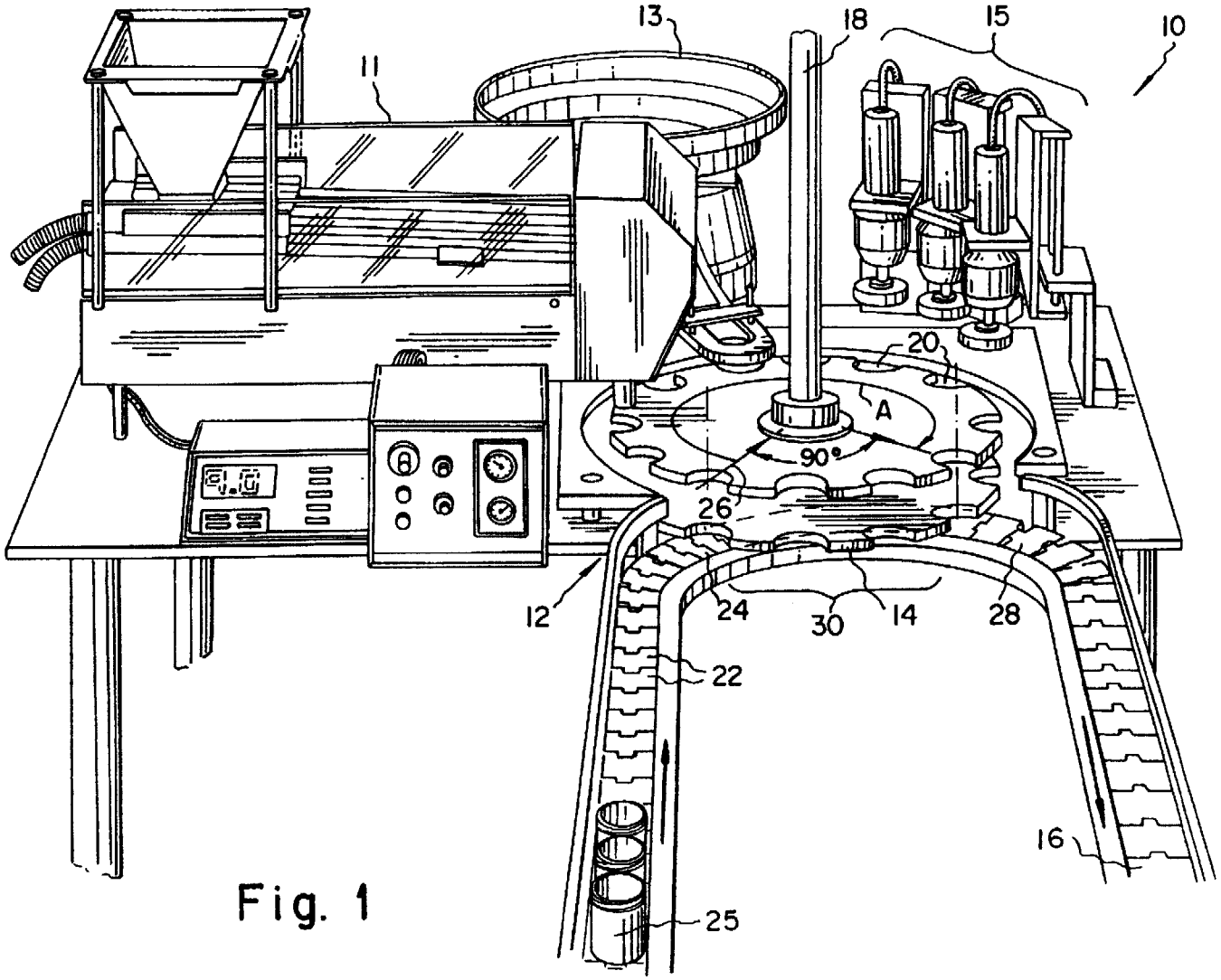

The annexed drawing illustrates a tablet filling monoblock, identified comprehensively by the reference numeral 10, which is a system for counting and dispensing tablets in containers advancing in serial order through the machine 10, and subsequently sealing the containers. More particularly, the machine 10 includes a tablet counting/filling station 11, a cap dispensing station 13 and torquing stations 15 to tighten the caps applied on the containers. The stations 11, 13 and 15 are of a known construction and will not be discussed in further detail. It may also be envisaged to provide a station for dispensing cotton wads (not shown in the drawings) in the containers, upstream the cap dispenser station, as it is known in the art.

The machine 10 features a novel container transport system 12 including a revolving turret 14 associated with a conveyor 16 for feeding empty containers to the revolving turret 14 and subsequently removing filled and sealed containers from the revolving turret 14.

The revolving turret 14 has a generally circular configuration and it rotates about a vertical axis 18. Around the circumference of the revolving turret 14 are provided regularly spaced container receiving pockets 20. Each pocket 20 presents an axis of symmetry about an imaginary dividing line which extends radially with respect to the revolution a exis 18. With this arrangement, a container can be placed in the pocket and removed therefrom along respective ingress and egress directions which extend in a radial direction with respect to the revolution axis 18. It should be appreciated that other pocket configurations are possible without departing from the spirit of the invention. For example, the pockets may not necessarily have a radial symmetry, in which can be the direction of entry and exit of the containers may not be purely radial either.

The conveyor 16 is endless and it is made of a plurality of slats 22 which are pivotally mounted to one another. The connection between adjacent slats is such as to allow them to move relatively to one another while remaining co-planar. In other words, the conveyor 16 may be caused to follow a curved path. Conveyors of this type are known and commercially available from various sources.

The conveyor 16 defines an infeed run 24 advancing empty containers 25 in a direction which is generally radial with respect to the revolving turret 14, as identified by the arrow 26 to insert the forwardmost container 25 in a pocket 20 in registration with the infeed run 24. Since the pocket 20 has a radial symmetry configuration, the container ingress direction is radial and corresponds perfectly to the direction along which the infeed run 24 advances the containers 25 to achieve a smooth entry action.

The conveyor 16 also defines an outfeed run 28 for removing the processed containers 25 from the revolving turret 14. Similarly to the infeed run 24, the outfeed run 28 advances the containers along a radial direction to coincide with the egress direction of a container 25 from the pocket 20 in registration with the outfeed run 28, so as to accomplish a container extraction which is as smooth as possible, minimizing the risk of disturbing the stability of the container which otherwise may cause the container to fall, necessitating to stop the machine 10.

Between the infeed and outfeed runs of the conveyor 16 is provided an intermediate segment 30 maintaining the continuity of the conveyor 16 between the infeed and the outfeed runs and passing beneath the revolving turret 14.

In reality, the infeed run 24, the outfeed run 28 and the intermediate segment 30 are all part of a single loop that is formed by a conveyor. This curved path is made possible by the ability of the adjacent slats 22 to perform a co-planar movement to alter the angular relationship therebetween, as discussed earlier. It should be appreciated that the container advancement directions by the infeed run 24 and the outfeed run 28 are not purely radial and they involve also a certain lateral component. However, this circumferential component is negligible and it does not significantly affect the loading and the unloading of the revolving turret with containers 25.

The infeed run 24 and the outfeed run 28 are at an angular relationship which approximates 90°. As a result, the effective sector A of the revolving turret 14 along which the processing stations 11, 13 and 15 are placed is considerable, being of approximately 270°. This permits to place a large number of processing stations so as to accomplish more operations on the containers 25 in a smaller space. When containers are moving through effective sector A, they are disengaged from the conveyor 16.

The machine 10 is also provided with a drive and control system which operates its various components such as the conveyor 16, the revolving turret 14 and the processing stations 11, 13 and 15. The drive and control system will not be described here because it does not form part of this invention.

The above description of a preferred embodiment of this invention should not be interpreted in any limiting manner as this embodiment may be refined and varied in various ways without departing from the spirit of the invention. The scope of the invention is defined in the annexed claims.

I claim:

1. An apparatus for processing containers, comprising:

a system for transporting containers in serial order, said system including:

a) a revolving turret defining a plurality of container-receiving pockets in a spaced apart relationship for serially advancing containers along a generally arcuate path;

b) a conveyor for supplying unprocessed containers to said revolving turret and for removing processed containers therefrom, said conveyor defining an infeed run for feeding containers to said revolving turret and an outfeed run to convey containers away from said revolving turret, said runs being in a substantially non-coaxial condition thereby said arcuate path has an angle substantially in excess of 180°, whereby movement of said conveyor causes a forwardmost, unprocessed container on said infeed run to enter a pocket registering with said infeed run and also causes said outfeed run to extract a processed container from a pocket registering therewith, said conveyor further including an intermediate segment, beneath a portion of said revolving turret other than a portion including said container receiving pockets, interconnecting said infeed and outfeed runs for maintaining the continuity of said conveyor therebetween, said revolving turret constituting means for disengaging a given container from said infeed run in order to advance the container along said arcuate path, said revolving turret also constituting means for engaging the container on said outfeed run when the container reaches an end of said arcuate path; and container-processing stations along said arcuate path, said stations processing containers advanced by said revolving turret in a consecutive order.

2. An apparatus as defined in claim 1, wherein said infeed and outfeed runs and said intermediate segment form part of a common loop formed by said conveyor.

3. An apparatus as defined in claim 1, wherein said conveyor comprises slats capable of relative co-planar movement.

4. An apparatus as defined in claim 1, wherein said container processing stations comprise means for counting tablets, means for depositing a predetermined number of tablets in containers advanced by said revolving turret and means for sealing filled containers.

5. An apparatus as defined in claim 1, wherein said container processing stations comprise means for counting tablets, means for depositing a predetermined number of tablets in containers advanced by said revolving turret and means for sealing filled containers.

6. An apparatus as defined in claim 2, wherein said arcuate path and said common loop only overlap at two positions.

7. An apparatus as defined in claim 1, wherein said conveyor comprises an endless conveyor.

* * * * *